US006750166B1

(12) United States Patent
Etzold et al.

(10) Patent No.: US 6,750,166 B1
(45) Date of Patent: Jun. 15, 2004

(54) METHOD FOR PRODUCING A NON-WOVEN FIBRE FABRIC

(75) Inventors: Stefan Etzold, Langenhagen (DE); Joachim Bauer, Hemmingen (DE)

(73) Assignee: Corovin GmbH, Peine (DE)

( * ) Notice: Subject to any disclaimer, the term of this patent is extended or adjusted under 35 U.S.C. 154(b) by 0 days.

(21) Appl. No.: 09/719,903

(22) PCT Filed: Jun. 18, 1999

(86) PCT No.: PCT/DE99/01793

§ 371 (c)(1),
(2), (4) Date: Dec. 20, 2000

(87) PCT Pub. No.: WO99/67454

PCT Pub. Date: Dec. 29, 1999

(30) Foreign Application Priority Data

Jun. 20, 1998 (DE) ..... 198 27 567

(51) Int. Cl.[7] ..... D04H 5/02; D04H 1/46; D04H 1/08; B32B 5/06

(52) U.S. Cl. ..... 442/329; 28/103; 28/104; 28/107; 28/116; 28/112

(58) Field of Search ..... 28/103–139

(56) References Cited

U.S. PATENT DOCUMENTS

| | | | | |
|---|---|---|---|---|
| 3,081,515 A | * | 3/1963 | Griswold et al. | 28/78 |
| 5,244,711 A | * | 9/1993 | Drelich et al. | 428/113 |
| 5,709,829 A | | 1/1998 | Giacometti | |
| 5,830,555 A | * | 11/1998 | Srinivasan et al. | 428/137 |

FOREIGN PATENT DOCUMENTS

| | | | | |
|---|---|---|---|---|
| DE | 2015 243 | | 10/1970 | |
| DE | 2015243 | | 10/1970 | |
| DE | 2149 525 | | 4/1972 | |
| DE | 34 16 004 | | 10/1985 | |
| DE | 195 81 616 | | 4/1997 | |
| DE | 297 20 192 | | 3/1999 | |
| EP | 0 214 608 | | 3/1987 | |
| EP | 0214608 | * | 3/1987 | ..... A61F/13/18 |
| EP | 0 687 757 | | 12/1995 | |
| GB | 1287063 | | 8/1972 | |

OTHER PUBLICATIONS

1224786– Karger et al– Patent Specification– Mar. 1971, Method of and apparatus for fabrication high strength fibre–reinforced sheets or mouldings provided with holes, slots, or other apertures.*

* cited by examiner

*Primary Examiner*—Cheryl A. Juska
*Assistant Examiner*—Lynda Salvatore
(74) *Attorney, Agent, or Firm*—Collard & Roe, P.C.

(57) ABSTRACT

Disclosed is a method for producing a non-woven fiber fabric comprising a plurality of perforated structures extending along the entire cross-section of said fabric. The inventive method consists of the following steps: in a first step, the matted fibers are placed on a belt screen to form a web of fibers; in a second step, the web of fibers is conveyed to a perforated-structure manufacturing unit, in a third step, the perforated structures are manufactured by mechanically impinging upon the fibers, whereby the mechanical impingement upon said fibers does not affect the mechanical and chemical structure thereof; and in a fourth step, the web of fibers provided with said perforated structures is compacted in a compaction unit for form a non-woven fabric.

20 Claims, 2 Drawing Sheets

METHOD FOR PRODUCING A NON-WOVEN FIBRE FABRIC

CROSS REFERENCE TO RELATED APPLICATIONS

Figure 1:
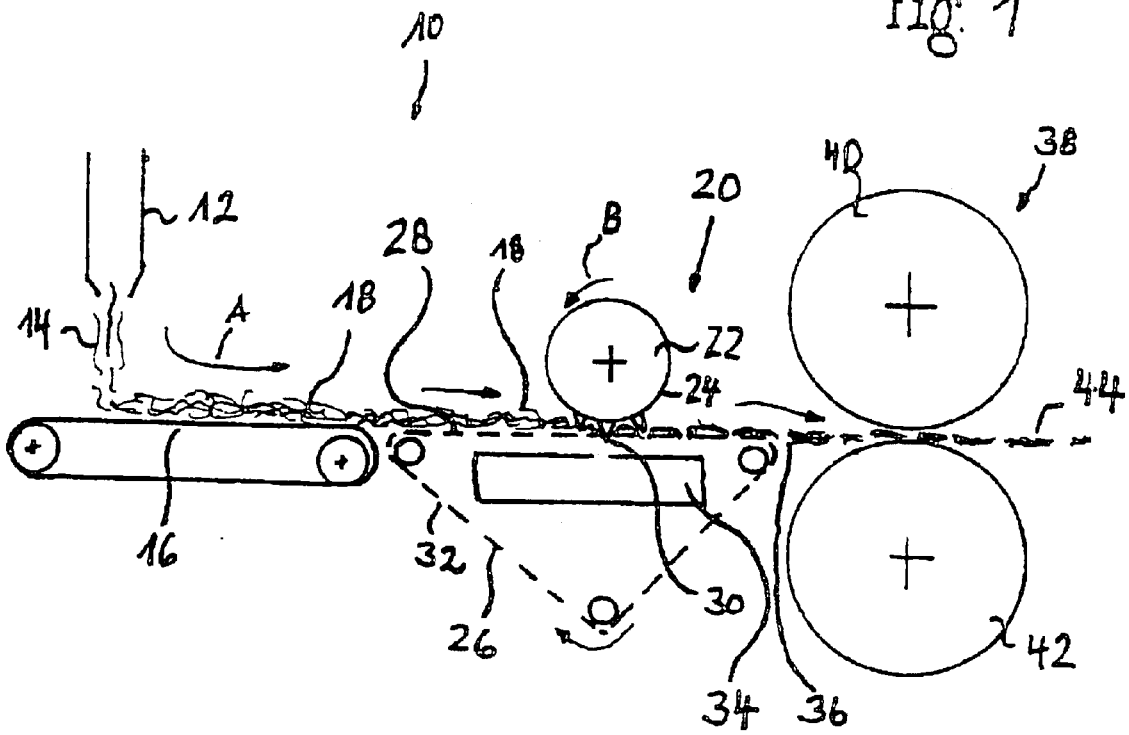

Applicants claim priority under 35 U.S.C. §119 of German Application No. 198 27 567.6 filed Jun. 20, 1998. Applicants also claim priority under 35 U.S.C. §120 of PCT/DE99/01793 filed Jun. 18, 1999. The international application under PCT article 21(2) was not published in English.

The invention concerns a procedure to make a fleece consisting of fibers with numerous hole structures extending over the entire cross-section, and a fleece manufactured according to this procedure.

One-layer or multilayer fleeces with hole structures extending over the entire cross-section are e.g. used for coverstock materials for articles of hygiene such as sanitary napkins and diapers, or for other textile or technical uses. The hole structures serve to quickly drain bodily fluids, tissue components and feces into the liquid-absorbing material of diapers, sanitary napkins, etc. Depending on the application, the fleeces can be single-layer or multilayer, whereby multilayer fleeces can be bonded with other sheet media such as films.

There are several prior-art procedures to introduce hole structures into a one-layer or multilayer fleece, whereby the common element of the prior-art procedures is that the hole structures are created in the finished fleece after bonding and especially thermobonding.

For example, a prior-art procedure in EP 0 687 757 A2 introduces hole structures into the bonded fleece by passing the fleece between heated stamps that are pressed together to melt holes in the bonded fleece. A similar prior-art procedure, a hot-needle punching procedure, is in U.S. Pat. No. 5,709,829.

The advantage of this procedure is that the bond of the fleece structure is held due to the melted edges that arise around the holes. A disadvantage is that the softness is negatively influenced by the relatively hard melted edges. A fleece obtained in this manner feels relatively hard and can be unpleasant to users.

In DE 34 16 004 A1, there is a prior-art process in which an unbonded fleece of thermoplastic fibers is fed to a calender roller arrangement, and the thermoplastic material is melted and displaced by pressure in the area of the holes by the calender roller arrangement. This produces a liquid bump at the edge of the holes to form a bonded grid to stabilize and fix the remaining fleece sheet. A hard melted edge is specifically created to reinforce the fleece sheet which is positive for the strength of the fleece sheet, but is disadvantageous due to the hardness of the melted edges.

In another prior-art procedure, the hole structures are created by (cold) stamping/cutting the fibers out of the bonded fleece. Such procedures have the advantage that hard stamped or melted edges do not arise, and materials obtained in this manner are soft. A disadvantage is that this procedure can only be done when the fleece is conveyed at a slow speed. In addition, the fibers are shortened along the holes which decreases the strength of the fleece.

A disadvantage of the cited procedures is that material is unnecessarily destroyed or wasted by hot and cold stamping or burning.

In another prior-art procedure in EP 0 214 608 A2, the fleece is manufactured and the hole structures are created by two rollers between which the fleece is guided. One roller has numerous heated needles, and the other roller has corresponding holes to receive the needles of the first roller. The needles purportedly displace the fibers while forming the hole structures and simultaneously form recesses around the hole structures, and they seal the edges of the hold structures by melting the fibers. In this procedure, the fibers are not shortened or destroyed, however hard melted edges arise that negatively influence the softness. In addition, it is involved and expensive to introduce hole structures after the fleece is thermobonded.

The problem of the invention is therefore to create a procedure that enables professionals to manufacture a fleece with hole structures that feels soft, the bond of the fibers is not weakened by introducing hole structures, the procedure can be done without waste, and it is simple and economical.

This problem is solved with a procedure of the initially-cited type that has the features of patent claim 1.

According to the invention, the fibers are randomly deposited on a screen belt to form a fibrous web in a first step of a procedure to create a fleece made of fibers with numerous hole structures extending over the entire cross-section of the fleece. In a second step, the fibrous web is transported to a hole-structure-creating machine; in a third step, the hole structures are created by mechanically displacing the fibers. The displacement of the fibers does not influence their mechanical and chemical structure. In a fourth step, the fibrous web with the hole structures is bonded in a bonding unit to form a fleece.

The invention is therefore based on the surprising knowledge that, to generate hole structures, it is sufficient to displace the fibers that cover the area of the holes to be formed and compress the fibers in this area and/or the neighboring area without having to destroy or impair the fibrous web in the area of the holes to be formed and/or its general appearance. In brief, the fibers of the fibrous web are reoriented in the area of the hole structures or diverted from their prior course in the procedure according to the invention before manufacturing the fleece by bonding and possibly thermobonding without requiring a heat treatment or simultaneous compression.

Suitable fibers or filaments for creating a fleece by the procedure according to the invention are any fibers or filaments suitable to form fleeces according to the various procedures, especially staple fibers, endless filaments, and bicomponent fibers and filaments. In particular, staple fibers are highly suitable.

It is particularly advantageous that no unnecessary waste or lost material arises, that the fibers are not shortened or destroyed in the area of the hole structures, and that the softness of the finished fleece is very good, and that no additional hardening at the edge of the hole structures impairs the softness of the finished fleece.

Such a solution has not been pursed to date since in particular in a prior-art process in EP 0 214 608 A2 it is assumed that the fibers would tend to return to their original position after being displaced due to the return effect which would eliminate the created hole structures. It was surprisingly shown that this return effect is irrelevant in the procedure according to the invention.

Before the third step, the fibrous web can be bonded to one or more fleeces and/or with another sheet medium such as a film.

In addition, the danger of the fibers springing back can be advantageously countered by feeding the fibrous web directly to the bonding unit after creating the hole structure.

In such a bonding unit, e.g. a calender roller arrangement, the fibrous web is compressed to create the finished fleece and, in an advantageous embodiment of the invention, it is simultaneously thermobonded. A very short path is desirable so that the hole structure is not lost while the fleece is being transported from the hole-structure-creating unit to the bonding unit.

In another advantageous embodiment of the invention, the fibrous web is prebonded before the third step so that the tensile strength of the prebonded fibrous web is 0.1 to 75% and especially 50% of the tensile strength of the bonded fleece.

The unbonded fibrous web is more-or-less held by a few widely-spaced bonding points or by applying pressure and/or heat. This provides a certain amount of mechanical stability to the fibrous web so that it can be transported faster to the hole-structure-creating unit. The faster speed enables faster manufacturing.

In an advantageous embodiment of the procedure, the fibers surrounding the hole structures are fixed before feeding the fibrous web to the bonding unit. This serves to prevent the hole structures from stretching while transporting the fibrous web with the hole structures. Fixing the fibers, i.e., slightly adhering the fibers around the hole structure can be done with suitable means such as by applying heat and/or pressure to the fibrous web, e.g. by smooth rollers.

In addition, the fourth step can be carried out with the hole-structure-creating unit directly after the third step. In this case, the hole structure-creating unit is simultaneously used for bonding.

In a practical embodiment of the invention, the hole-structure-creating unit has two elements with facing surfaces between which the fibrous web is guided, whereby the surface of a first element has numerous barbs facing the fibrous web, and whereby the surface of a second element has openings in which the barbs of the first surface can at least partially enter, whereby the fibers of the fibrous web below the barbs are displaced without being destroyed when the barbs sink into the openings and the hole structures are formed.

In an advantageous embodiment of the invention, the openings of the second surface communicate with a source for a vacuum or pressure such as a blower so that fibers of the fibrous web in the area of the openings are sucked into or blown out of the openings. By sucking the fibers into the openings of the second surface, such a blower can support the nondestructive displacement of the fibers to form the hole structures, and the blower can blow the fibrous web with the hole structures away from the second surface to gently prevent potential adhesion of the fibrous web to the second surface after creating the hole structures.

The channels and openings of the vacuum source can shaped and dimensioned so that the fibers to be deformed or reoriented that are sucked into the openings and channel of the vacuum source are not caught.

In another advantageous embodiment of the invention, the first element is a roller. In practical embodiments of the invention, the roller has a diameter of 100–500 mm. Such a roller can be advantageous when a relatively fast production speed is to be attained.

In an alternate embodiment of the invention, the first element is a raising and lowering plate. Such a plate that can create discontinuous hole structures can be advantageous when the fibers are to be slowly and carefully displaced.

In practical embodiments of the invention, the barbs of the first element are conical or have an involuted shape or an ogival cross-section, whereby the barbs can have a practical height of 0.5–5 mm. Various shapes, sizes and heights of the barbs are used depending on the requirements, of the fleece to be created that can be single-layer multilayer fleece, e.g. a SMS fleece or a combination of fleece and other sheet media.

In another practical embodiment of the invention, the second element is a perforated belt. The fibrous web to be treated can be placed on such a perforated belt and transported to the first element where the barbs of the first element penetrate through the fibrous web into the holes of the perforated belt. Alternately, the second element can be calender roller. A calender roller would also be used as the second element.

In another practical embodiment of the invention, a fleece created by the procedure according to the invention has hole structures with a diameter of 0.5–5 mm, the bonding surface is 3–40% of the fleece surface, and the number of bonding points is 20–120 per square centimeter. Such a number of bonding points and a corresponding diameter of hole structures ensures a sufficient number of bonding points at the edge of the hole structures, and this fixes the hole structure so that the displaced filaments around the hole structures after hardening and thermobonding no longer return to their original position.

Figure 2:
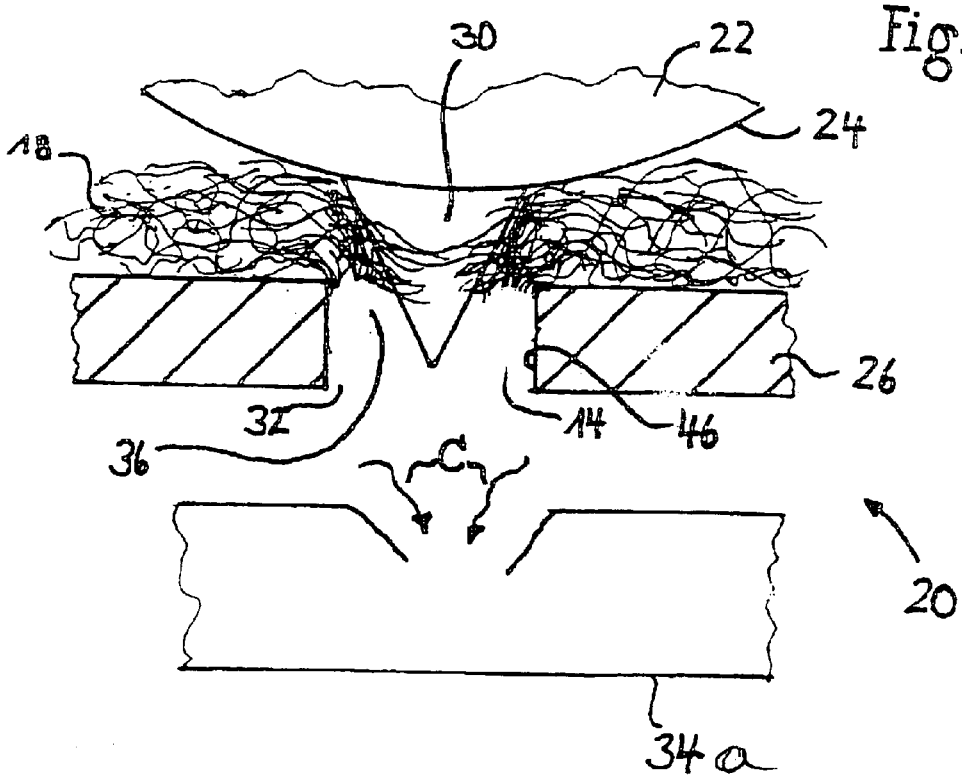
Figure 3:
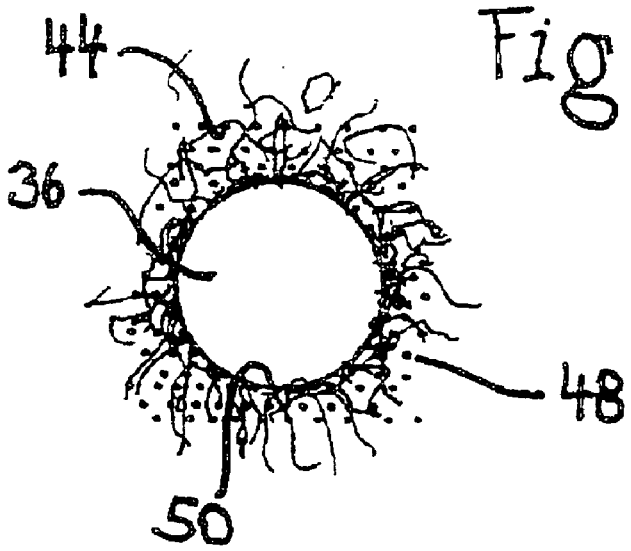
Figure 4:
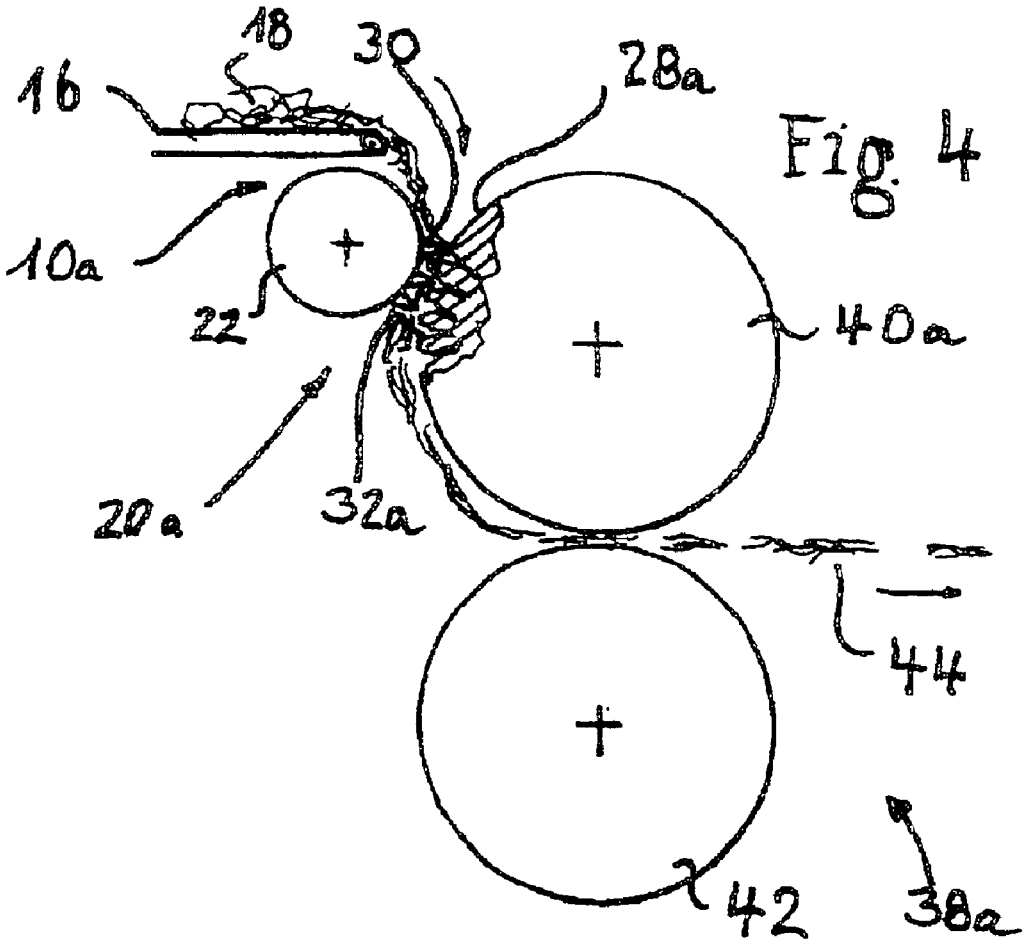

Other advantages and embodiments of the invention will be portrayed with reference to exemplary embodiments in the following description, the drawing, and in the patent claims. Shown in the drawing are:

FIG. 1 A schematic portrayal of a system for the procedure according to the invention, FIG. 2 A detailed view of a hole-structure-creating unit of the system from FIG. 1, FIG. 3 A top view of a hole structure of a fleece created by the procedure according to the invention, and FIG. 4 An alternative embodiment of a system for the procedure according to the invention viewed from the side.

FIG. 1 shows a first embodiment of a system 10 for the procedure according to the invention. With a suitable and schematically portrayed device 12, a fibrous web 18 of fibers 14 is created and placed on a screen belt 16. As indicated with the arrow A, a fibrous web 18 consisting of fibers 14 is transported to a hole-structure-creating unit 20. This hole-structure-creating unit 20 consists of a roller 22 whose outer surface 24 that forms the first surface 24 of the hole-structure creating unit 20 is above a perforated belt 26 with a surface 28 that faces the roller 22. This surface 28 forms the second surface 28 of the hole-structure creating unit 20.

The surface 24 of the roller 22 is provided with numerous barbs 30 that can at least partially enter the holes 32 in the perforated belt 26. As indicated by arrow B, the roller 22 rotates counterclockwise. Corresponding to the speed at which the perforated belt 26 is conveyed, the barbs 30 (of which only three are illustrated in FIG. 1 for the sake of simplification) continually penetrate the holes 32 and displace the filaments 14 of the fibrous web 18 at this site.

Under the perforated belt 26 is a vacuum/pressure source that will be discussed further below. FIG. 1 shows pressure source 34.

After the fibrous web 18 has passed through both surfaces 24, 28, the fibrous web 18 that now has hole structures 36 reaches a bonding unit 38. This bonding unit 38 consists of two calender rollers 40, 42 in the arrangement 10 in FIG. 1. The fibrous web 18 undergoes thermal bonding from the calender rollers 40, 42 that the finished fleece 44 leaves the calender rollers 40, 42.

FIG. 2 shows details of the hole-structure-creating unit 20 on a much larger scale than FIG. 1. As indicated by arrow C, the vacuum source 34*a* generates a vacuum which sucks the filaments 14 of the fibrous web 18 over the hole 32 of the perforated belt 26 are sucked into the hole 32. This creates a sort of trough through which the barbs 30 of the roller 32 can more easily penetrate through the fibrous web 18 into the holes 32 so that the filaments 14 of the fibrous web 18 are not destroyed but rather only displaced or reoriented in the area of the hole 32 to be formed.

To make it easier to remove the fibrous web 18 from the perforated belt 26 after the hole structure 36 is generated, it is possible to create pressure to lift the filaments that hang in a hole 32 of the perforated belt 26 so that the filaments 14 cannot contact the edge 46 of the hole 32 when the fibrous web 18 is lifted from the perforated belt 28.

FIG. 3 shows a detailed example of a hole structure 36 in fleece 44 created by the procedure according to the invention. As can be seen, the fleece 44 has numerous bonding sites 48 created by the calender rollers 40, 42 that are evenly distributed over the entire surface of the fleece 44. By correspondingly adjusting the size, number and distribution of the bonding points, it is possible to provide the hole structure 36 with a sufficient number of bonding points at the edge 50 as well so that the bonding points 48 stabilize the hole structure 36.

FIG. 4 shows a partial area of a second embodiment of system 10*a* for the procedure according to the invention. Here as well, the hole-structure-creating unit 20*a* has roller 22 corresponding to the roller 22 in FIG. 1. The second surface 28*a* is the outer surface of the calendar roller 40*a*. Correspondingly, the surface 28*a* of the calender roller 40*a* is provided with holes 32*a* that can be penetrated by barbs 30 of the roller 22. These holes 32*a* are also connected to a vacuum source (not shown)

The arrangement 10*a* shown in FIG. 4 makes it possible to dispense with the perforated belt 26 and shorten the transport path from the hole-structure-creating unit 20*a* to the bonding unit 38*a* in contrast to the arrangement 10 in FIG. 1.

What is claimed is:

1. A procedure to create a fleece (44) made of fibers (14) with numerous hole structures (36) extending over the entire cross-section of the fleece (44), comprising:

in a first step, the fibers (14) are randomly placed on a perforated belt (16) to form a fibrous web (18), in a second step, the fibrous web (18) is transported to a hole-structure-creating unit (20; 20*a*), in a third step, the hole-structure-creating unit (20; 20*a*) is a calendar having two rollers with facing surfaces (24, 28; 28*a*) between which the fibrous web (18) is guided, and the surface (24) of a first roller has numerous barbs (30) facing the fibrous web (18) and the surface (28; 28*a*) of a second roller (26; 40*a*) has openings (32, 32*a*) in which the barbs (3) of the first surface (24) can at least partially enter, such that the fibers (14) of the fibrous web (18) below the barbs (30) are displaced without being destroyed when the barbs (30) sink into the openings (32; 32*a*) and the hole structures (36) are formed without a heat treatment or simultaneous compression, and the hole structures (36) are created by mechanically displacing the fibers (14), and the displacement of the fibers (14) does not influence their mechanical and chemical structure, and in a fourth step, directly after creating the hole structure, the fibrous web (18) with the hole structures (36) is bonded in a calendar roller arrangement (38; 38*a*) to form a fleece (44);

wherein the fibrous web (18) is additionally transformed by stiffening and thermobonding to form a fleece (44); and wherein before the third step, the fibrous web (18) is prebonded so that the tensile strength of the prebonded fibrous web (18) is 0.1 to 75% of the tensile strength of the bonded fleece (4).

2. A procedure according to claim 1, wherein the fibers (14) surrounding the hole structures (36) are additionally fixed before feeding the fibrous web (18) to the bonding unit (38; 38*a*).

3. A procedure to create a fleece (44) made of fibers (14) with numerous hole structures (36) extending over the entire cross-section of the fleece (44), comprising:

in a first step, the fibers (14) are randomly placed on a perforated belt (16) to form a fibrous web (18), in a second step, the fibrous web (18) is transported to a hole-structure-creating unit (20; 20*a*), in a third step, the hole-structure-creating unit (20; 20*a*) is a calendar having two rollers with facing surfaces (24, 28; 28*a*) between which the fibrous web (18) is guided, and the surface (24) of a first roller has numerous barbs (30) facing the fibrous web (18) and the surface (28; 28*a*) of a second roller (26; 40*a*) has openings (32, 32*a*) in which the barbs (3) of the first surface (24) can at least partially enter, such that the fibers (14) of the fibrous web (18) below the barbs (30) are displaced without being destroyed when the barbs (30) sink into the openings (32; 32*a*) and the hole structures (36) are formed without a heat treatment or simultaneous compression, and the hole structures (36) are created by mechanically displacing the fibers (14) and the displacement of the fibers (14) does not influence their mechanical and chemical structure, and in a fourth step, directly after creating the hole structure, the fibrous web (18) with the hole structures (36) is bonded in a calendar roller arrangement (38; 38*a*) to form a fleece (44); and wherein the fibrous web (18) is fed directly to the bonding unit (38; 38*a*) after the hole structure (36) is created.

4. A procedure according to claim 3, wherein the fourth step directly follows the third step.

5. A procedure according to claim 1, wherein the openings (32; 32*a*) of the second surface (28; 28*a*) communicate with a vacuum source so that fibers (14) of the fibrous web (18) in the area of the openings (32; 32*a*) are sucked into the openings (32; 32*a*).

6. A procedure according to claim 1, wherein the openings (32; 32*a*) of the second surface (28; 28*a*) communicate with a pressure source so that fibers (14) of the fibrous web (18) in the area of the openings (32; 32*a*) are blown out of the openings (32; 32*a*).

7. A procedure according to claim 1, wherein the roller has a diameter of 100–500 mm.

8. A procedure according to claim 1, further comprising a first element which is a lowering and raising plate.

9. A procedure according to claim 1, wherein the barbs (30) of the first element are conical.

10. A procedure according to claim 1, wherein the barbs (30) have an involuted shape.

11. A procedure according to claim 1, wherein the barbs (30) have an ogival cross-section.

12. A procedure according to claim 1, wherein the barbs are 0.5–5 mm high.

13. A procedure according to claim 1, further comprising a second element which is a perforated belt.

14. A procedure according to claim 1, wherein the hole structures (36) have a diameter of 0.5–5 mm.

15. A procedure according to claim 14, wherein the bonding surface is 3–40% of the fleece surface.

16. A procedure according to claim 14, wherein the number of bonding points (48) is 20–120 per square centimeter.

17. A procedure according to claim 14, wherein the shape of the hole structures (36) is noncircular.

18. A procedure according to claim 14, wherein the distance between individual hole structures (36) is irregular.

19. A procedure according to claim 1, wherein the fibrous web (18) is bonded to at least one other sheet medium before creating the hole structures (36).

20. A procedure according to claim 1, wherein before the third step, the fibrous web (18) is prebonded so that the tensile strength of the prebonded fibrous web (18) is 0.1 to 50% of the tensile strength of the bonded fleece (4).

* * * * *